US009401542B2

(12) United States Patent
Autti et al.

(10) Patent No.: US 9,401,542 B2
(45) Date of Patent: Jul. 26, 2016

(54) ANTENNA ARRANGEMENT

(71) Applicant: Broadcom Corporation, Irvine, CA (US)

(72) Inventors: Marko Tapio Autti, Oulu (FI); Seppo Rousu, Oulu (FI)

(73) Assignee: BROADCOM CORPORATION, Irvine, CA (US)

( * ) Notice: Subject to any disclaimer, the term of this patent is extended or adjusted under 35 U.S.C. 154(b) by 450 days.

(21) Appl. No.: 13/864,449

(22) Filed: Apr. 17, 2013

(65) Prior Publication Data

US 2013/0278472 A1 Oct. 24, 2013

(51) Int. Cl.
*H01Q 1/00* (2006.01)
*H01Q 5/00* (2015.01)
*H01Q 5/321* (2015.01)

(52) U.S. Cl.
CPC ..... *H01Q 5/0034* (2013.01); *H01Q 5/321* (2015.01)

(58) Field of Classification Search
CPC ..... H01Q 5/00; H01Q 7/005; H01Q 13/103; H01Q 5/321; H01Q 5/0034
USPC ..... 343/722, 857, 702, 750; 455/77
See application file for complete search history.

(56) References Cited

U.S. PATENT DOCUMENTS 4,080,601 A * 3/1978 Alcorn, Jr. ..... H01P 1/2133 333/202
2008/0238789 A1* 10/2008 Wilcox ..... H04B 1/0458 343/750
2009/0132007 A1* 5/2009 Snitting ..... A61N 1/025 607/60

* cited by examiner

*Primary Examiner* — Dieu H Duong
(74) *Attorney, Agent, or Firm* — Oblon, McClelland, Maier & Neustadt, L.L.P.

(57) ABSTRACT

Apparatus, methods, computer software and computer program products are provided for tuning a user equipment antenna to simultaneously operate at more than one resonant frequency by combining a first electrical load and a first frequency selective component to tune the antenna to a first resonant frequency with respect to signals in a first frequency range, and combining a second electrical load and a second frequency selective component to tune the antenna to a second resonant frequency with respect to signals in a second frequency range. The first electrical load, the second electrical load, the first frequency selective component and the second frequency selective component act to tune the antenna to operate simultaneously at the first resonant frequency and the second resonant frequency.

19 Claims, 12 Drawing Sheets

ANTENNA ARRANGEMENT

CROSS REFERENCE TO RELATED APPLICATION

This application claims the benefit under 35 U.S.C. §119 (a) and 37 CFR §1.55 to UK patent application no. 1207164.3, filed on Apr. 24, 2012, the entire content of which is incorporated herein by reference.

TECHNICAL FIELD

The present disclosure relates to antennas. In particular, but not exclusively, the present disclosure relates to methods, apparatus, computer software and computer program products for use in tuning user equipment antennas.

BACKGROUND

A user equipment (UE) typically conducts wireless communications by transmitting and receiving electromagnetic signals via one or more antennas. Antennas are transducers for converting energy between electronic signals processed internally by the UE, and electromagnetic signals which propagate through a transport medium (such as the air). Such signals typically include a data component which contains information being communicated, and a carrier component which is used to modulate the data component and determines the centre frequency of the signal. Electrical signals applied to an antenna by a UE cause corresponding electromagnetic signals to be transmitted by the antenna. Likewise, electromagnetic signals received at the antenna cause the generation of corresponding electrical signals that can then be processed by UE circuitry (including demodulation of the signals to isolate data components from carrier components).

The efficiency of the power converted by the antenna depends on the impedance matching at the interface between the antenna and the UE circuitry (also known as the feed-point). The impedance of the feed-point is in turn influenced by the physical properties of the antenna. For example, a dipole antenna is best served to transmit and receive electromagnetic signals having a wavelength of twice (or close to twice) the length of the antenna conductor. This is because a standing half-wave is formed along the length of a dipole antenna. The frequency of an electromagnetic signal corresponding to such a wavelength is termed the antenna's natural resonant frequency. For a monopole antenna, the natural resonant frequency is the frequency of an electromagnetic waveform having a wavelength four times for close to four times) the length of the antenna.

The feed-point impedance experienced by a signal oscillating at the natural resonant frequency of an antenna is purely resistive, and hence provides for an efficient transfer of power between the antenna and the UE circuitry. However, for signals oscillating at frequencies that deviate from the natural resonant frequency of the antenna, the experienced feed-point impedance becomes increasingly reactive, resulting in a reduction in the power conversion efficiency. At such frequencies, converted signals may be too weak to be reliably isolated from general noise, resulting in poor reliability communications.

The rate at which the power conversion efficiency decreases as signal frequencies deviate away from the natural resonant frequency of the antenna is determined by further physical properties of the antenna. For a given frequency at a fixed deviation from the natural resonant frequency of the antenna, an antenna with a larger diameter conductor provides a feed-point impedance that is less reactive than an antenna with a smaller diameter conductor. Hence, antennas with larger diameter conductors provide a wider useful bandwidth in which energy can be reasonably efficiently converted.

Modern UEs conduct communications at frequencies in the multiple hundreds of megahertz or low gigahertz. To transmit or receive such signals with to naturally resonant antenna would require an antenna that is larger than would be comfortably portable. In order to maintain the portability of modern UEs, much smaller antennas are used. Such antennas are forced to transmit and receive signals at frequencies that are far away from the antennas natural resonant frequency. At such frequencies, the feed point impedance is almost entirely reactive and the power conversion efficiency is very low. In order to enable communications under such conditions, an electrical load (also known as a matching network) can be used to alter the resonant frequency of the antenna, as shown in FIG. 1.

At the desired communication frequency, antenna 100 provides a feed-point impedance at interface 102 that is largely reactive. In order to enable effective communications at the desired communication frequency, electrical load 104 is introduced. The impedance of electrical load 104 is selected to cancel the reactive feed-point impedance of antenna 100 at the desired communication frequency, thereby making the feed-point impedance entirely resistive at that frequency. This has the effect of tuning antenna 100 to have its resonant frequency at the desired communication frequency. Typically, this is achieved by selecting an electrical load of an equal but opposite reactance. In the case described above, where the communication frequency is much lower than the natural resonant frequency of the antenna, the feed-point impedance at the desired communication frequency will be capacitive. Hence, a corresponding inductive electrical load can be selected to cancel out the net reactance.

Recent developments in communications protocols, satellite positioning and other radio access technologies are putting further strain on antenna design constraints. For example, multiple-input multiple-output (MIMO; also known as diversity) schemes require the use of multiple antennas simultaneously, which further limits the space available to each one, and may provide differing dimensional constraints because the antennas require orthogonal orientation. Also, carrier aggregation schemes often require further antennas, each configured to conduct communications at different frequencies, and/or require the use of wider bandwidths, which results in further strain on the dimensional constraints.

Hence, it would be desirable to provide improved measures for tuning UE antennas.

SUMMARY

In accordance with the embodiments described herein there is apparatus, methods, computer software and computer program products for tuning a user equipment antenna.

In accordance with first embodiments, there is a user equipment antenna apparatus, the apparatus comprising:

a first electrical load;

a second electrical load;

a first frequency selective component; and a second frequency selective component, wherein the first electrical load and the first frequency selective component are adapted to tune the antenna to a first resonant frequency with respect to signals in a first frequency range, wherein the second electrical load and the second frequency selective component are adapted to tune the antenna to a second resonant frequency with respect to signals in a second frequency range, and wherein the first electrical load, the second electrical load, the first frequency selective component and the second frequency selective component are adapted to tune the antenna to operate simultaneously at at least the first resonant frequency and the second resonant frequency.

In accordance with second embodiments, there is a method of operating a user equipment antenna, the method comprising:

tuning the antenna to a first resonant frequency with respect to signals in a first frequency range using a first electrical load and a first frequency selective component; and tuning the antenna to a second resonant frequency with respect to signals in a second frequency range using a second electrical load and a second frequency selective component, wherein the antenna is tuned to operate simultaneously at at least the first resonant frequency and the second resonant frequency using the first electrical load, the second electrical load, the first frequency selective component and the second frequency selective component.

In accordance with third embodiments, there is computer software adapted to perform a method of operating a user equipment antenna according to the second embodiments.

In fourth embodiments, there is a computer program product comprising a non-transitory computer-readable storage medium having computer readable instructions stored thereon, the computer readable instructions being executable by a computerized device to cause the computerized device to perform a method of operating a user equipment antenna according to the second embodiments.

Further features and advantages will become apparent from the following description of preferred embodiments, given by way of example only, which is made with reference to the accompanying drawings.

DETAILED DESCRIPTION

Embodiments of the present disclosure enable a user equipment antenna to be tuned to multiple resonant frequencies simultaneously. Embodiments allow the same antenna to be used for conducting communications at a larger range of frequencies. Embodiments alleviate the requirements for multiple antennas and/or support for wider bandwidths in a given UE.

Figure 1:
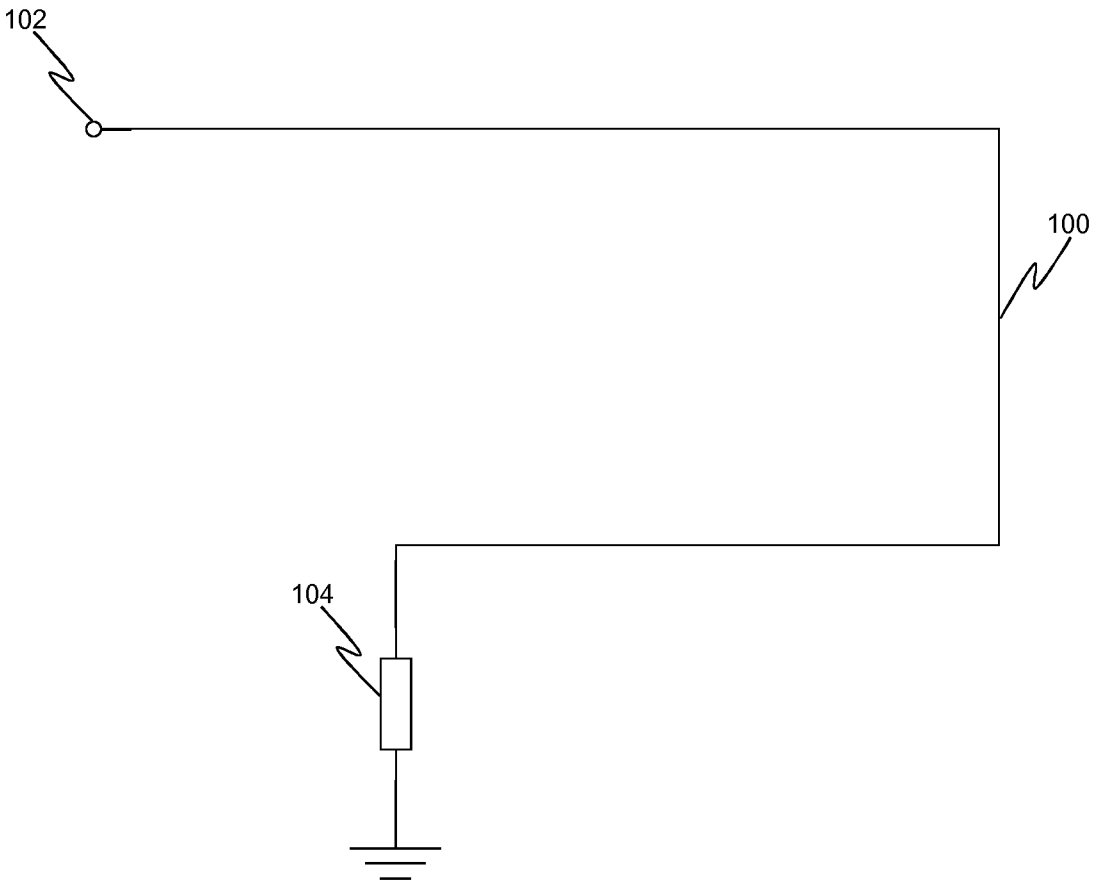
Figure 1 PRIOR ART
FIG. 1 illustrates a conventional apparatus for use in tuning a user equipment antenna.
Figure 2:
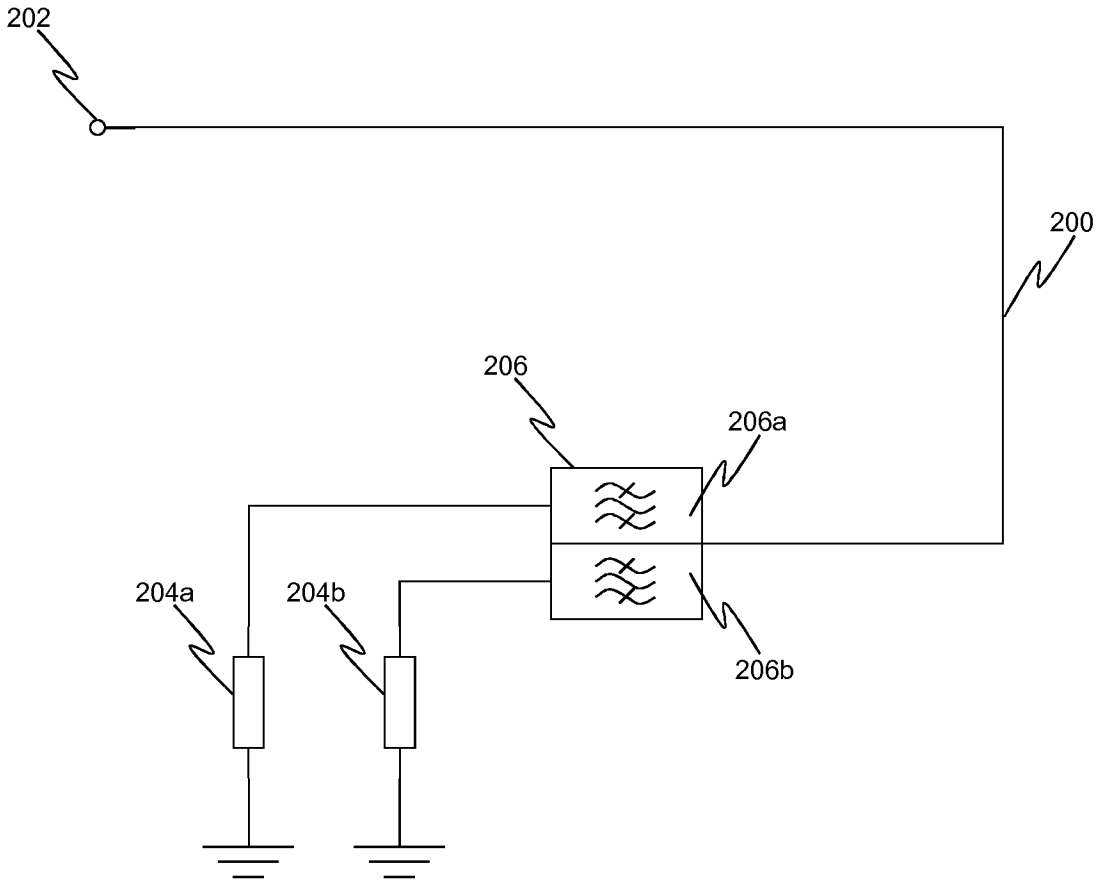
FIG. 2 illustrates an apparatus for use in tuning a user equipment antenna according to embodiments.

FIG. 2 illustrates an apparatus for use in tuning a user equipment antenna 200 according to embodiments. Electronic signals are passed to and from antenna 200 via electrical interface 202. The apparatus includes electrical loads 204*a* and 204*b*, and frequency selective component block 206. Frequency selective component block 206 includes frequency selective component 206*a* and frequency selective component 206*b*, which electrically connect antenna 200 to electrical loads 204*a* and 204*b* respectively. Frequency selective components 206*a* and 206*b* may include one or more filters, acid/or one or more other components with frequency dependent behaviour such as isolators, circulators, couplers, and switches. Hereinafter, frequency selective components and frequency selective component blocks will be referred to as filters and filter blocks respectively, although suitable alternative frequency selective components are to be considered to ball within the meaning of these terms.

Filter 206*a* is adopted to selectively pass signals in a first frequency range between antenna 200 and electrical load 204*a*. Hence, for signals in the first frequency range, electrical load 204*a* serves to tune antenna 200 to a first resonant frequency by altering the reactance of the feed-point impedance experienced at electrical interface 202 for signals in that frequency range. Similarly, filter 206*b* is adapted to selectively pass signals in 4 second frequency range between antenna 200 and electrical load 204*b*. Hence, for signals in the second frequency range, electrical load 204*b* serves to tune antenna 200 to a second resonant frequency by altering the reactance of the feed-point impedance experienced at electrical interface 202 for signals in that frequency range. The result of the operation of the above described tuning apparatus is that the single antenna 200 is tuned to multiple resonant frequencies simultaneously.

In some embodiments, the impedance values of electrical loads 204*a* and 204*b* are selected to tune antenna 200 to resonant frequencies within the ranges of frequencies that are passed by filters 206*a* and 206*b* respectively. This is achieved by selecting each impedance value to reduce the reactive component of the feed-point impedance experienced at interface 202 at a desired frequency. The result of this is that the antenna operates effectively for signals in the first frequency range and the second frequency range simultaneously. Hence, a broader range of frequencies are made available for conducting simultaneous communications via a single antenna 200.

In alternative embodiments, the antenna is tuned to resonant frequencies that are outside the corresponding frequency ranges, but to be sufficiently near to the corresponding frequency ranges to enable reliable communication of signals in that frequency range.

In the embodiments shown in FIG. 2, filters 206*a* and 206*b* are band-pass filters adapted to selectively pass different ranges of frequencies between the antenna and electrical loads 204*a* and 204*b* respectively.

In embodiments, the ranges of frequencies passed by filters 206*a* and 206*b* are exclusive to each other in order to prevent there being a range of frequencies at which both electrical loads 204*a* and 204*b* are connected to antenna 200.

In some embodiments, filter block 206 is a duplex filter. In alternative embodiments one of filters 206*a* and 206*b* is a low-pass filter. Additionally or alternatively, one of filters 206*a* and 206*b* could be a high-pass filter. By using a low-pass filter or high-pass filter instead of a hand pass filter where possible, a reduction in silicon area requirements and hence chipset costs may be achieved.

In the embodiments shown in FIG. 2, the tuning apparatus causes antenna 200 to present different resonant frequencies to different frequencies of electrical signals at the single electrical interface 202. According to some embodiments, electrical interface 202 is electrically connected to a signal processing component, which may include one or more of a transmitter, a receiver and/or a transceiver (a combined transmitter and receiver). According to some embodiments, one or more intermediate components may be arranged between the signal processing component and the electrical interface, which may include one or more of a switch, a power amplifier, a filter bank, and/or an antenna tuner. Where the signals processed in each frequency range are provided to a single transmitter and/or receiver, such as carrier signals used in a contiguous carrier aggregation scheme, this provides a larger total range of frequencies for effectively conducting communications via antenna 200.

In some circumstances, it is desirable to share the same antenna between more than one transmitter and/or receiver, for example where the signals processed in each frequency range are used in a non-contiguous or inter-band carrier aggregation scheme, or when the signals correspond to different communication standards or even different radio access technologies, such as satellite positioning system transmitters and/or receivers. Hence, according to some embodiments, an apparatus for use in tuning a user equipment antenna is provided with multiple electrical interfaces.

Figure 3A:
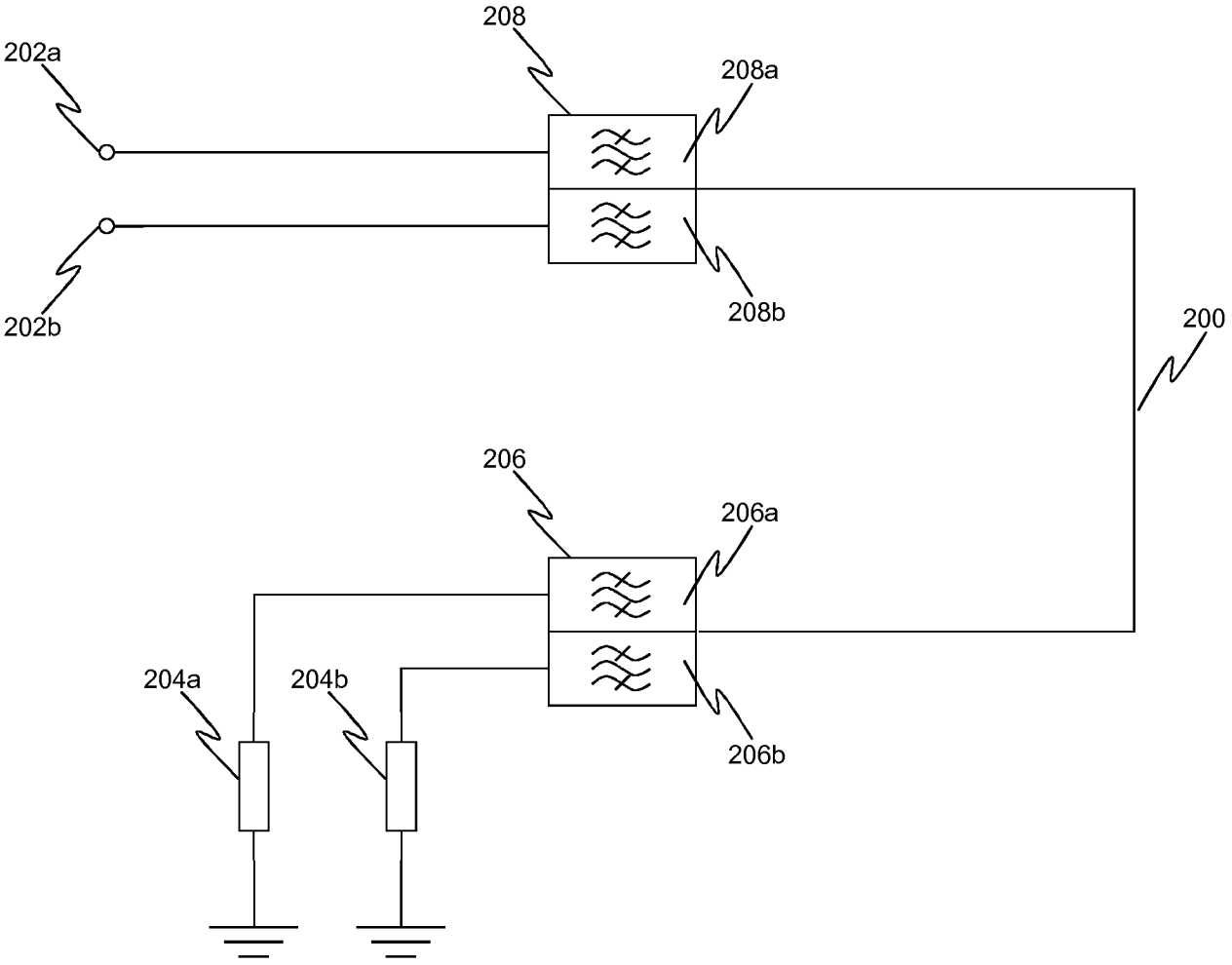
FIG. 3*a* illustrates an apparatus having multiple electrical interfaces for use in tuning a user equipment antenna according to embodiments.

FIG. 3*a* illustrates an apparatus having multiple electrical interfaces 202*a* 202*b* for use in tuning a user equipment antenna 200 according to embodiments. Electronic signals are passed to and from antenna 200 via electrical interfaces 202*a* and 202*b*. The apparatus includes electrical loads 204*a* and 204*b*, and filter blocks 206 and 208. The operation of electrical loads 204*a* and 204*b*, and filter block 206 (comprising filters 206*a* and 206*b*) function in a similar manner to as described previously in relation to FIG. 2. Filter block 208 includes filter 208*a* and filter 208*b*, which electrically connect antenna 200 to electrical interfaces 202*a* and 202*b* respectively. The frequency ranges of signals passed by filters 208*a* and 208*b* correspond to the frequency ranges passed by filters 206*a* and 206*b* respectively. This correspondence of frequency ranges means that there is a range of frequencies which is passed by both filters 206*a* and 208*a*, and a different range of frequencies passed by both filters 206*b* and 208*b*. For example, the total ranges of frequencies passed by filters 208*a* and 208*b* may be the same as the total ranges of frequencies passed by filters 206*a* and 206*b*, or merely overlap the total ranges of frequencies passed by filters 206*a* and 206*b* for the frequency ranges of interest.

In the embodiments shown in FIG. 3*a*, filters 208*a* and 208*b* are band-pass filters adapted to selectively pass different ranges of frequencies between antenna 200 and electrical interfaces 202*a* and 202*b* respectively.

In embodiments, the ranges of frequencies passed by filters 208*a* and 208*b* are exclusive to each other in order to prevent there being a range of frequencies at which both electrical interfaces 202*a* and 202*b* are connected to antenna 200.

In embodiments, filter block 208 is a duplex filter.

In embodiments one of filters 208*a* and 208*b* is a low-pass filter.

In embodiments, one of lifters 208*a* and 208*b* is a high-pass filter.

The operation of embodiments will now be described in relation to FIGS. 3*b* and 3*c*.

Figure 3B:
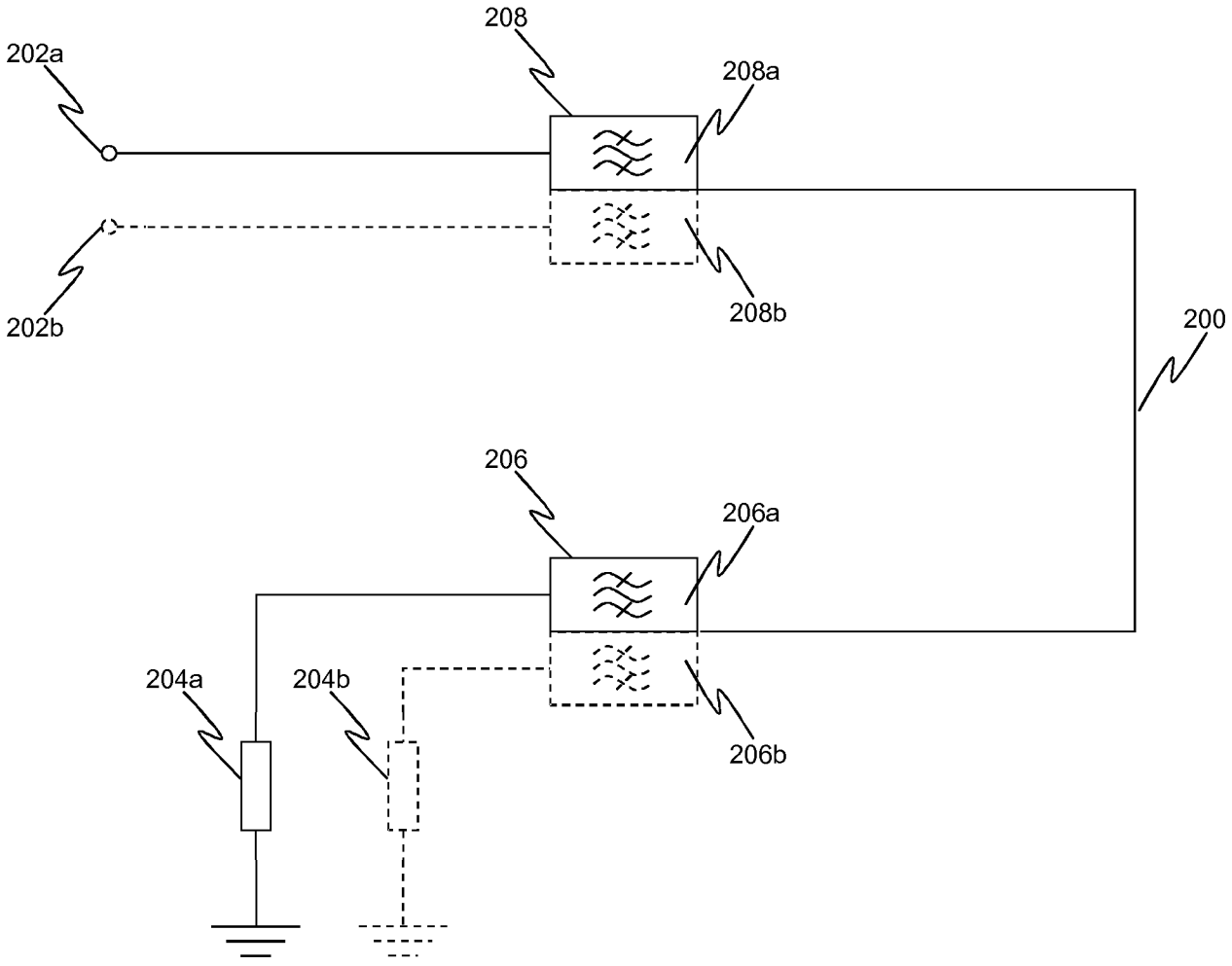
FIG. 3*b* illustrates the operation of embodiments in relation to signals in a first frequency range.

FIG. 3*b* illustrates the operation of embodiments in relation to signals in the first frequency range (i.e. the range of frequencies passed by both filter 206*a* and 208*a*). Signals in the first frequency range are not passed, or are at least significantly attenuated, by filters 206*b* or 208*b*, as shown by dashed lines in FIG. 3*b*. Hence, electrical interface 202*b* and electrical load 204*b* are effectively isolated from antenna 200 for signals in the first frequency range, as shown by dashed lines in FIG. 3*b*. However, signals in the first frequency range are passed by filters 206*a* and 208*a*, as shown by solid lines in FIG. 3*b*, and hence a conducting path is created for such signals between electrical interface 202*a* and electrical load 204*a* via antenna 200. This has the effect of tuning the antenna to a first resonant frequency for signals in the first frequency range by altering the feed point impedance experienced at interface 202*a*.

Figure 3C:
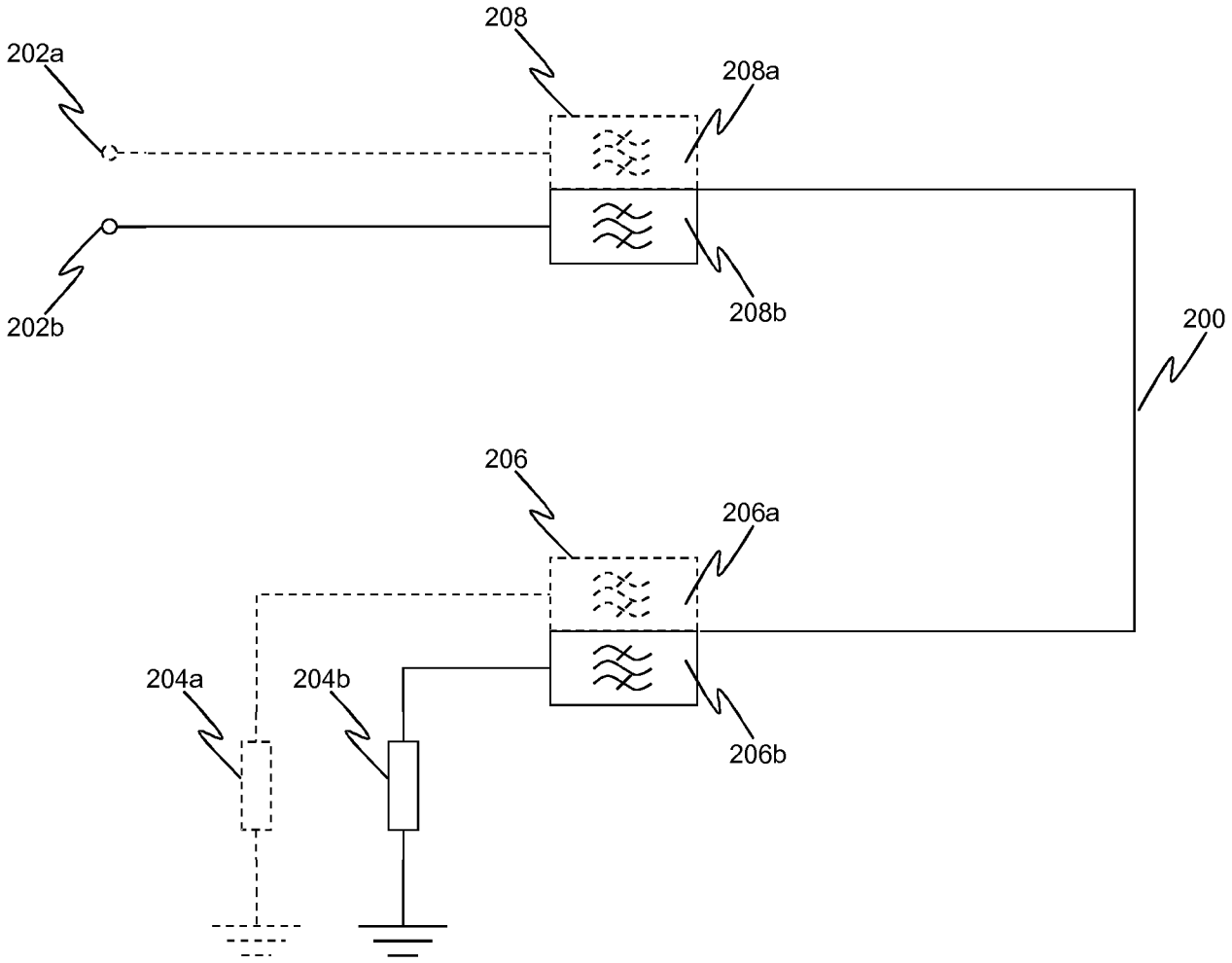
FIG. 3*c* illustrates the operation of embodiments in relation to signals in a second frequency range.

FIG. 3*c* illustrates the operation of embodiments in relation to signals in the second frequency range (i.e. the range of frequencies passed by both filter 206*b* and 208*b*). Signals in the second frequency range are not passed by filters 206*a* or 208*a*, as shown by dashed lines in FIG. 3*c*. Hence, for such signals, electrical interface 202*a* and electrical load 204*a* are not electrically connected to antenna 200, as shown by dashed lines in FIG. 3*c*. However, signals in the second frequency range are passed by filters 206*b* and 208*b*, as shown by solid lines in FIG. 3*c*, and hence a conducting path is created for such signals between electrical interface 202*b* and electrical load 204*b* via antenna 200. This has the effect of tuning the antenna to a second resonant frequency for signals in the second frequency range by altering the feed point impedance experienced at interface 202*b*.

Hence, antenna 200 is tuned to operate simultaneously at multiple resonant frequencies; a first resonant frequency for signals in the first frequency range passing via interface 202*a* and a second resonant frequency for signals in the second frequency range passing via interface 202*b*. In this way, antenna 200 can be shared between two transmitters and/or two receivers simultaneously, each adapted to conduct communications in different frequency ranges via antenna 200. According to some embodiments, electrical interfaces 202*a* and 202*b* are each electrically connected to signal processing components, which may each include one or more of as transmitter, a receiver and/or a transceiver. According to some embodiments, one or more intermediate components may be arranged between each signal processing component and the corresponding electrical interface, which may include one or more of a switch, a power amplifier, a filter bank, and/or an antenna tuner.

Figure 4A:
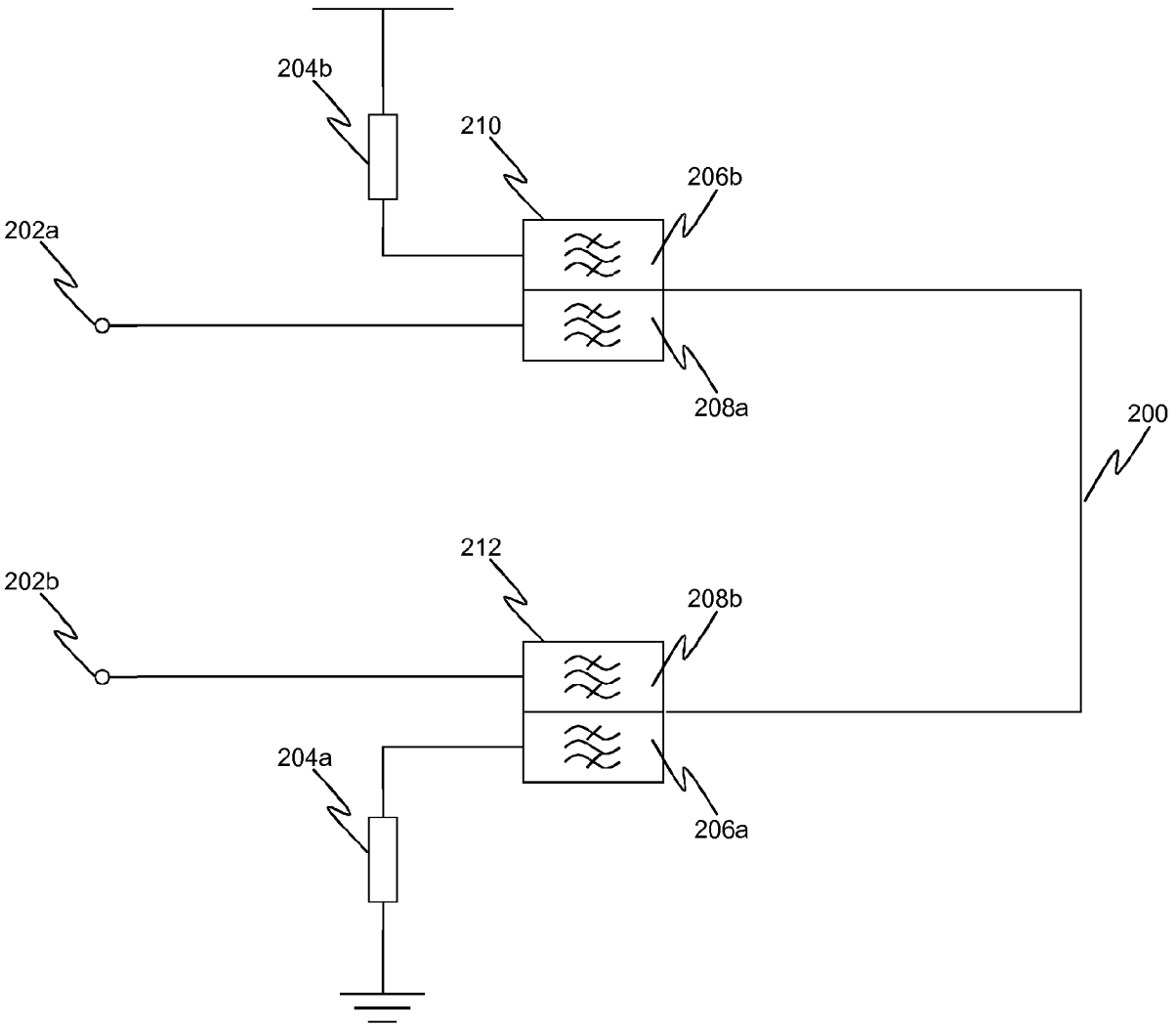
FIG. 4*a* illustrates an apparatus baying multiple electrical interfaces for use in tuning a user equipment antenna according to embodiments.

FIG. 4*a* illustrates an apparatus having multiple electrical interfaces for use in tuning a user equipment antenna 200 according to further embodiments. The apparatus includes electrical interfaces 202*a* and 202*b*, electrical loads 204*a* and 204*b*, filters 206*a*, 206*b*, 208*a* and 208*b*, the operation of which is similar to as described previously with respect to FIG. 3*a*. However, by modifying their relative locations with respect to antenna 200, certain operational and design advantages can be achieved. For example, by locating the electrical interfaces at opposing ends of the antenna, electrical isolation between any connected signal processing components (e.g. transmitters/receivers) can be improved. Further, by arranging the signal processing components to interface with antenna 200 via filters in different filter blocks, the embodiments shown in FIG. 4*a* may achieve greater isolation between signal processing components than would be provided if both signal processing components interfaced with antenna 200 via the same filter block, which in turn can serve to improve co-existence.

Further, by locating signal processing components at opposite ends of shared antenna 200, the use of band selection switches can be avoided in certain cases. Band selection switches are a significant source of harmonic noise, which can lead to performance degradation when those harmonics are generated in frequency ranges used by other signal processing components. Hence, by avoiding the use of band selection switches, performance can be increased for some signal processing components. Also, in embodiments where the signal processing components are included in separate packages (e.g. integrated circuits, ASICs etc.) and are therefore likely to occupy different locations on a printed wiring board, circuit routing can be improved by this arrangement.

Filter block 210 includes filter 206*b* and filter 208*a*, which electrically connect antenna 200 to electrical load 204*b* and electrical interface 202.*a* respectively. In some embodiments, filter block 210 is a duplex filter. Filter block 212 includes filter 206*a* and filter 208*b*, which electrically connect antenna 200 to electrical load 204*a* and electrical interface 202*b* respectively. In some embodiments, filter block 212 is a duplex filter.

The operation of such embodiments will now be described in relation to FIGS. 4*b* and 4*c*.

Figure 4B:
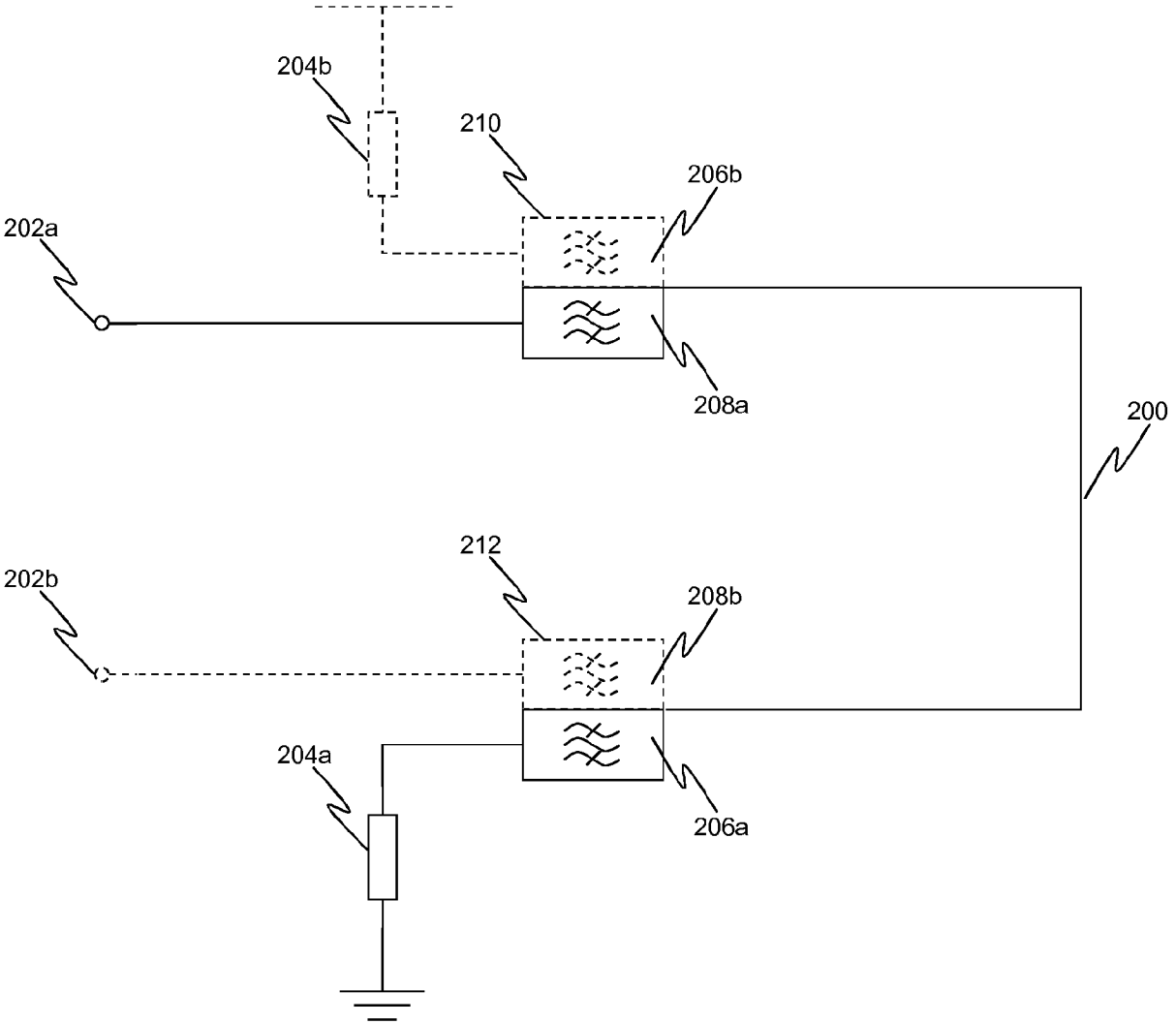
FIG. 4*b* illustrates the operation of embodiments in relation to signals in a first frequency range.

FIG. 4*b* illustrates the operation of embodiments in relation to signals in the first frequency range (i.e. the range of frequencies passed by both filter 206*a* and 208*a*). Signals in the first frequency range are not passed by filters 206*b* or 208*b*, as shown by dashed lines in FIG. 4*b*. Hence, for such signals, electrical interface 202*b* and electrical load 204*b* are not electrically connected to antenna 200, as shown by dashed lines in FIG. 4*b*. However, signals in the first frequency range are passed by filters 206*a* and 208*a*, as shown by the solid lines in FIG. 4*b*, and hence a conducting path is created for such signals between electrical interface 202*a* and electrical load 204*a* via antenna 200. This has the effect of tuning the antenna to a first resonant frequency for signals in the first frequency range by altering the feed point impedance experienced cat interface 202*a*.

Figure 4C:
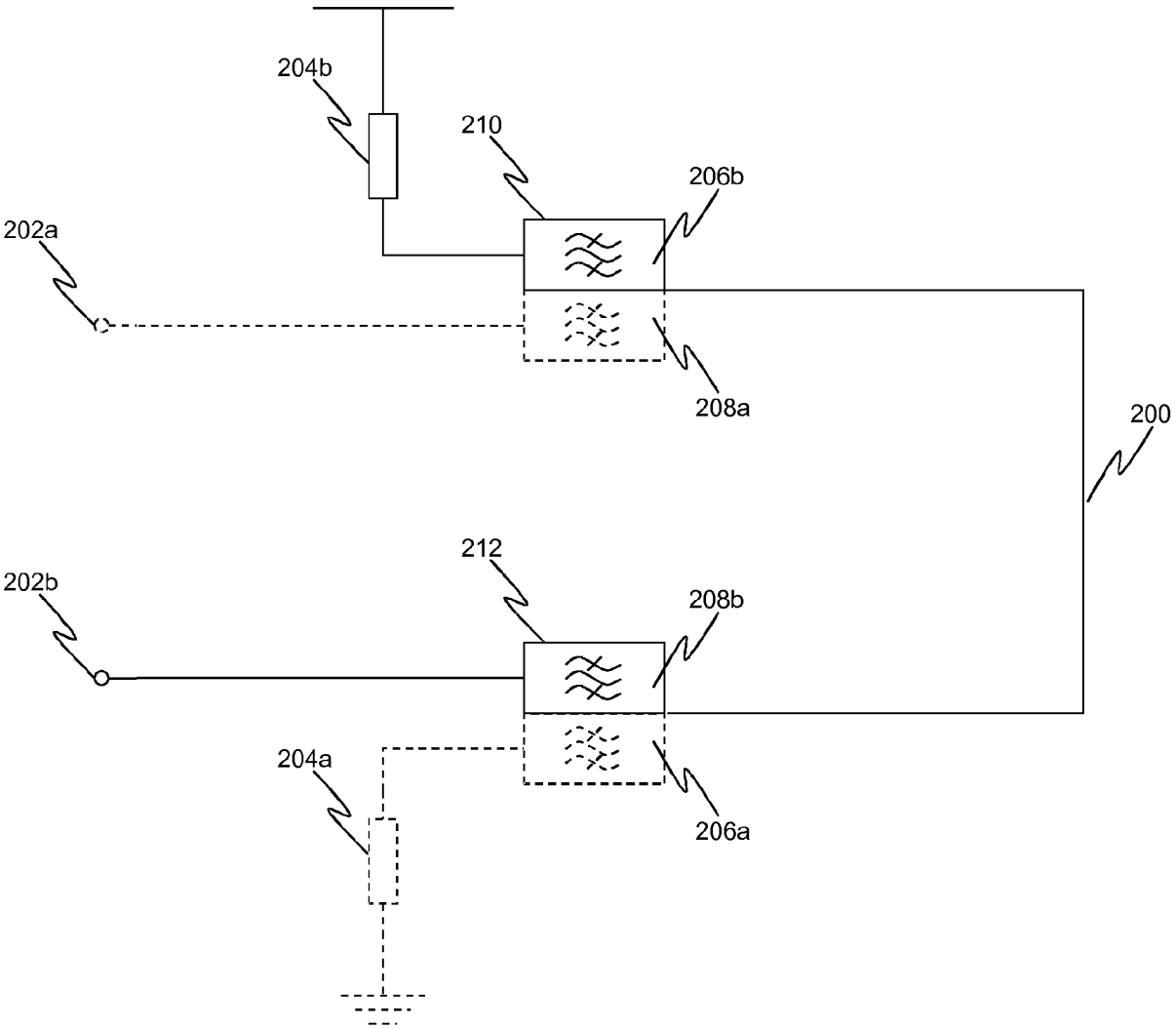
FIG. 4*c* illustrates the operation of embodiments in relation to signals in a second frequency range.

FIG. 4*c* illustrates the operation of embodiments in relation to signals in the second frequency range (i.e. the range of frequencies passed by both filter 206*b* and 208*b*). Signals in the second frequency range are not passed, or are at least significantly attenuated, by filters 206*a* or 208*a*, as shown by dashed lines in FIG. 4*c*. Hence, for such signals, electrical interface 202*a* and electrical load 204*a* are effectively isolated from antenna 200, as shown by dashed lines in FIG. 4*c*. However, signals in the second frequency range are passed by filters 206*b* and 208*b*, as shown by solid lines in FIG. 4*c*, and hence a conducting path is created for such signals between electrical interface 202*b* and electrical load 204*b* via antenna 200. This has the effect of tuning the antenna to a second resonant frequency for signals iii the second frequency range by altering the feed point impedance experienced at interface 202*b*.

Hence, antenna 200 is tuned to operate simultaneously at multiple resonant frequencies; a first resonant frequency for signals in the first frequency range passing via interface 202*a* and a second resonant frequency for signals in the second frequency range passing via interface 202*b*. In this way, antenna 200 can be shared between two or more transmitters, two or more receivers, and/or two or more transceivers (combined transmitters and receivers) simultaneously, each adapted to conduct communications in different frequency ranges via antenna 200.

According to some embodiments, the impedances of the electrical loads and the filter profiles of the filters are fixed. However, a UE may be required to change the ranges of frequencies at which signals are transmitted or received. This may happen for example, when the UE is first turned on, when the UE begins communicating with a different remote party, after a certain period of time has elapsed, when the UE moves into a new geographical location or in response to a request received from a remote party. Hence, according to some embodiments, one or more of the impedances of the electrical loads and/or the filter profiles of the filters are controllable and the apparatus is thus capable of retuning the antenna from an initial tuning configuration to an alternative tuning configuration.

The alternative arrangements illustrated in FIGS. 3*a* and 4*a* may provide different signal isolation between signals transmitted by each signal processing component. The different feed point locations utilised by each arrangement allow for different antenna radiation pattern design, which may provide different directivity, polarisation and/or phase relationships. Hence, an informed choice between these two arrangements can provide improved data throughput, lower power consumption, more concurrently running applications, higher data classes, etc. The different feed point locations may also more readily complement the mechanical form factor of a given UE.

Figure 5:
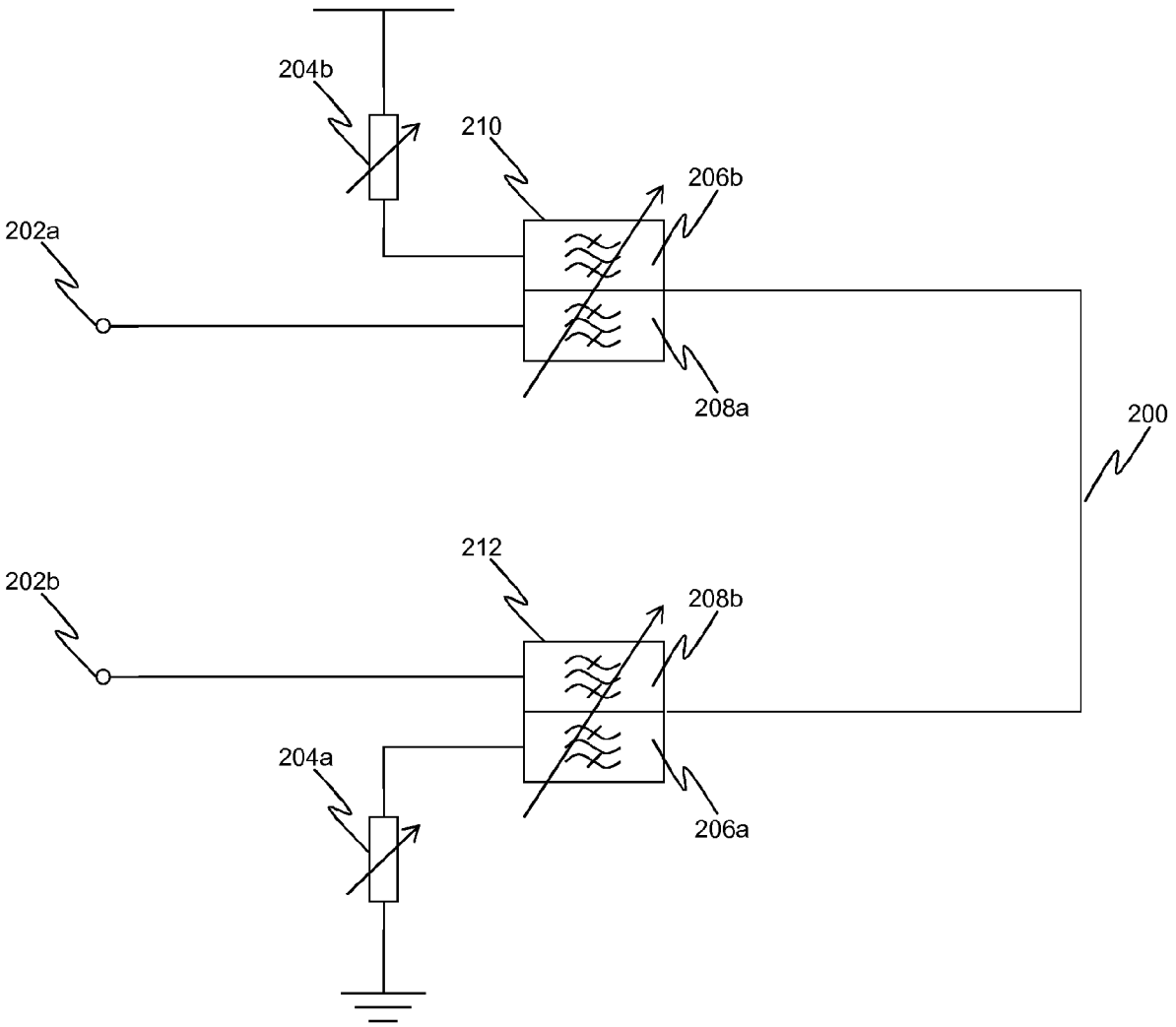
FIG. 5 illustrates an apparatus for use in tuning a user equipment antenna according to embodiments.

FIG. 5 illustrates art apparatus for use in tuning a user equipment antenna 200 according to further embodiments, wherein the apparatus is capable of retuning the antenna. The apparatus includes electrical interfaces 202*a* and 202*b*, electrical loads 204*a* and 204*b*, filters 206*a*, 206*b*, 208*a* and 208*b*, the operation of which is similar to as described previously with respect to FIG. 3*a*. However, one or more of electrical loads 204*a* and 204*b*, and filters 206*a*, 206*b*, 208*a* and 208*b* are controllable, as shown by the arrows in FIG. 5.

By altering the impedance of electrical load 204*a*, the resonant frequency of the antenna for signals in the first frequency range is altered accordingly. Similarly, by altering the impedance of electrical load 204*b*, the resonant frequency of the antenna for signals in the second frequency range is altered accordingly.

By altering the filter profile of filter 206*a* and/or filter 208*a*, the range of frequencies included by the first frequency range is altered accordingly. Similarly, by altering the filter profile of filter 206*b* and/or filter 208*b*, the range of frequencies included by the second frequency range is altered accordingly.

According to such embodiments, one or more of electrical loads 204*a* and 204*b*, filters 206*a*, 206*b*, 208*a* and 208*b* may include one or more variable capacitors and/or variable inductors. Alternatively one or more of electrical loads 204*a* and 204*b*, filters 206*a*, 206*b*, 208*a* and 208*b* may include an array of impedances and a switching, arrangement for electrically connecting the impedances within the respective electrical load or filter, whereby to alter the resulting impedance or filter profile.

According to some embodiments, the impedances and/or filter profiles of the one or more controllable electrical loads and/or filters are electronically controllable. In some embodiments, a control module interfaces with each of the controllable components via one or more control inputs (not shown)

which are used to configure the respective impedances and/or filter profiles of each controllable component. Such a control module may be included within the UE or a constituent part thereof, such as an application processor, a radio frequency integrated circuit (RFIC), a modem etc. Alternatively, or in addition, control signals which are operable to alter the respective impedances and/or filter profiles of each controllable component may be received from another entity in a telecommunications network or a remote party with which the UE is conducting communications.

In order to retune antenna 200 for the transmission or receipt of signals at a different range of frequencies, a resonant frequency of the antenna may need to be altered, and/or a frequency range of the filter blocks may need to be altered. According to some embodiments, whilst the UE is conducting communications in a first frequency range, the apparatus is adapted to retune the antenna with respect to signals in a second frequency range. This may be to provide an alternative operational frequency band for the communications being conducted in the first frequency range, to provide additional bandwidth for the communications taking place in the first frequency range (e.g. via carrier aggregation), or to facilitate separate simultaneous communications in the second frequency range.

In the embodiments shown in FIGS. 2 to 5, the tuning apparatus causes antenna 200 to be tuned to two different resonant frequencies simultaneously. However, in some circumstances, the antenna can be tuned to operate with greater than two resonant frequencies. This can be achieved by adding, consecutively further filters and loads to the tuning apparatus.

Figure 6:
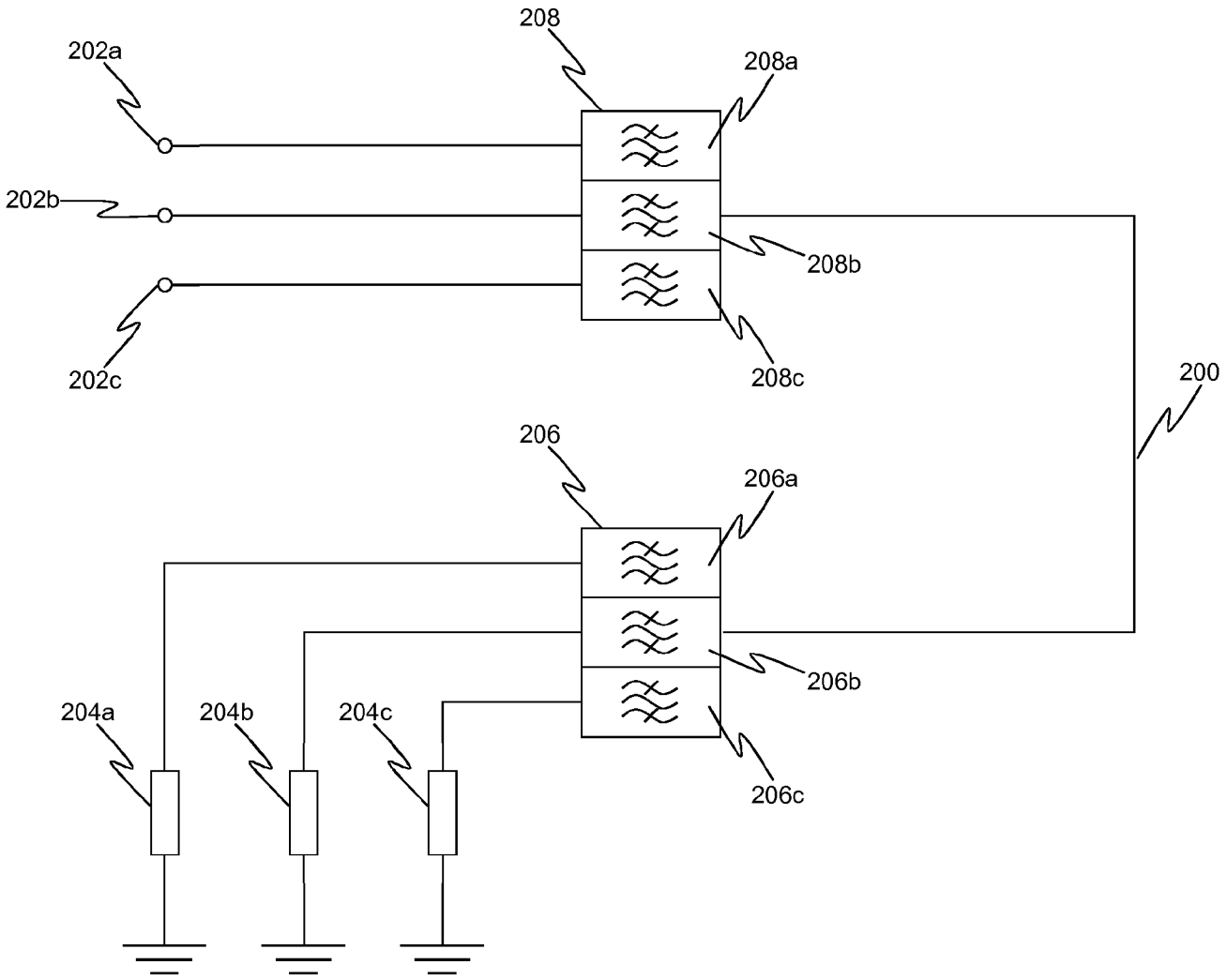
FIG. 6 illustrates an apparatus for use in tuning a user equipment antenna according to embodiments.

FIG. 6 illustrates an apparatus for use in tuning a user equipment antenna 200 according to further embodiments. The apparatus includes electrical interfaces 202*a* and 202*b*, electrical loads 204*a* and 204*b*, filters 206*a*, 206*b*, 208*n* and 208*b*, the operation of which is similar to as described previously with respect to FIG. 3*a*. Filter block 208 further includes filter 208*c*, which electrically connects antenna 200 to electrical interface 202*c*. Filter 208*c* is adapted to selectively pass signals in a third frequency range between antenna 200 and electrical interface 202*c*. Additionally, filter block 206 further includes filter 206*c*, which electrically connects antenna 200 to electrical load 204*c*. Filter 206*c* is adapted to selectively pass signals in a third frequency nine between antenna 200 and electrical load 204*c*. The frequency range of signals passed by filter 206*c* corresponds to the frequency range of signals passed by filter 208*c*, in a similar manner as described previously in relation to FIG. 3*a*.

Hence, for signals in the third frequency range, electrical load 204*c* serves to tune antenna 200 to a third resonant frequency by altering the reactance of the feed-point impedance experienced at electrical interface 202*c* for signals in that frequency range.

Hence, antenna 200 is tuned to a multiple resonant frequencies simultaneously; a first resonant frequency for signals in the first frequency range passing via interface 202*a*, a second resonant frequency for signals in the second frequency range passing via interface 202*b* and a third resonant frequency for signals in the third frequency range passing via interface 202*c*. In this way, antenna 200 can be shared between more than two transmitters, more than two receivers, and/or more than two transceivers simultaneously, each adapted to conduct communications in different frequency ranges via antenna 200. Whilst the arrangement shown in FIG. 6 tunes the antenna to three resonant frequencies simultaneously, further embodiments are capable of tuning the antenna to further resonant frequencies by consecutively adding further filters and further electrical loads in a similar manner.

In the embodiments shown in FIG. 6, filters 206*a*, 206*b* and 206*c* are band-pass filters adapted to selectively pass different ranges of frequencies between the antenna and electrical loads 204*a*, 204*b* and 204*c* respectively.

In embodiments, the ranges of frequencies passed by filters 206*a*, 206*b* and 206*c* are exclusive to each other in order to prevent there being a range of frequencies at which more than one of the electrical loads 204*a*, 204*b* and 204*c* are connected to antenna 200.

In embodiments, filter block 206 is a multiplex filter.

In embodiments, one of filters 206*a*, 206*b* and 206*c* is a low-pass filter.

In embodiments, one of filters 206*a*, 206*b* and 206*c* is a high-pass filter.

In the embodiments shown in FIG. 6, filters 208*a*, 208*b* and 208*c* are band-pass filters adapted to selectively pass different ranges of frequencies between the antenna and electrical interfaces 202*a*, 202*b* and 202*c* respectively.

In embodiments, the ranges of frequencies passed by filters 208*a*, 208*b* and 208*c* are exclusive to each other in order to prevent there being a range of frequencies at which more than one of the electrical interfaces 202*a*, 202*b* and 202*c* are connected to antenna 200.

In embodiments, filter block 208 is a multiplex filter.

In embodiments one of filters 208*a*, 208*b* and 208*c* is a low-pass filter.

In embodiments, one of filters 208*a*, 208*b* and 208*c* is a high-pass filter.

In various embodiments an electronic device is provided comprising the aforementioned tuning apparatus, such as a user terminal, or one or more components thereof such as for example a wireless modem configured for use in a user terminal.

Figure 7:
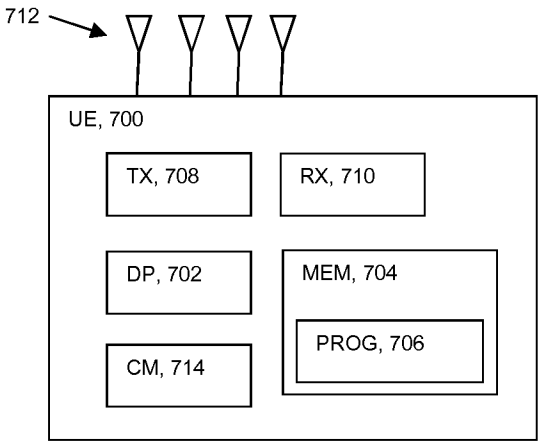
FIG. 7 is a simplified block diagram of an electronic device which may include the apparatus shown in FIGS. 2 to 5.

Reference is now made to FIG. 7 for illustrating a simplified block diagram of an electronic device suitable for use in practicing the embodiments.

FIG. 7 depicts a mobile apparatus, such as a mobile terminal or UE 700. The UE 700 includes processing means such as at least one data processor (DP) 702 (or processing system), storing means such as at least one computer-readable memory (MEM) 704 storing at least one computer program (PROG) 706, and also communicating means such as a receiver RX 710 and a transmitter TX 708 configured according to embodiments for one or more of downlink, uplink and bidirectional wireless communications via antennas 712. Antennas 712 may include one or more of a main antenna, secondary antenna, downlink MIMO antenna, uplink MIMO antenna, diversity antenna, receiver antenna, transmitter antenna, transceiver antenna, satellite positioning antenna, short range communication antenna and cellular network communication link antenna. According to some embodiments, UE 700 also includes control module 714 for controlling and altering the impedance of one or more of the electrical loads in the tuning apparatus and/or the frequency ranges passed by one or more of the frequency selective components in the tuning apparatus.

It will be understood that the various embodiments described herein include circuitry that May be provided by a single chip or integrated circuit or plural chips or integrated circuits, optionally provided as a chipset, an application-specific integrated circuit (ASIC), field-programmable gate array (FPGA), etc. The chip or chips may include circuitry (as well as possibly firmware) for embodying at least one or more of the aforementioned components, including control circuitry, digital signal processor or processors, baseband circuitry and radio frequency circuitry, which are configurable so as to operate in accordance with the embodiments. In this regard, embodiments may be implemented at least in part by computer software stored in memory and executable by a processor, or by hardware, or by a combination of tangibly stored software and hardware (and tangibly stored firmware).

The program may be in the form of non-transitory source code, object code, a code intermediate source and object code such as in partially compiled form, or in any other non-transitory form suitable for use in the implementation of processes according to embodiments. The carrier may be any entity or device capable of carrying the program. For example, the carrier may include a storage medium, such as a solid-state drive (SSD) or other semiconductor-based RAM; a ROM, for example a CD ROM or a semiconductor ROM; a magnetic recording medium, for example a floppy disk or hard disk; optical memory devices in general; etc.

Figure 8:
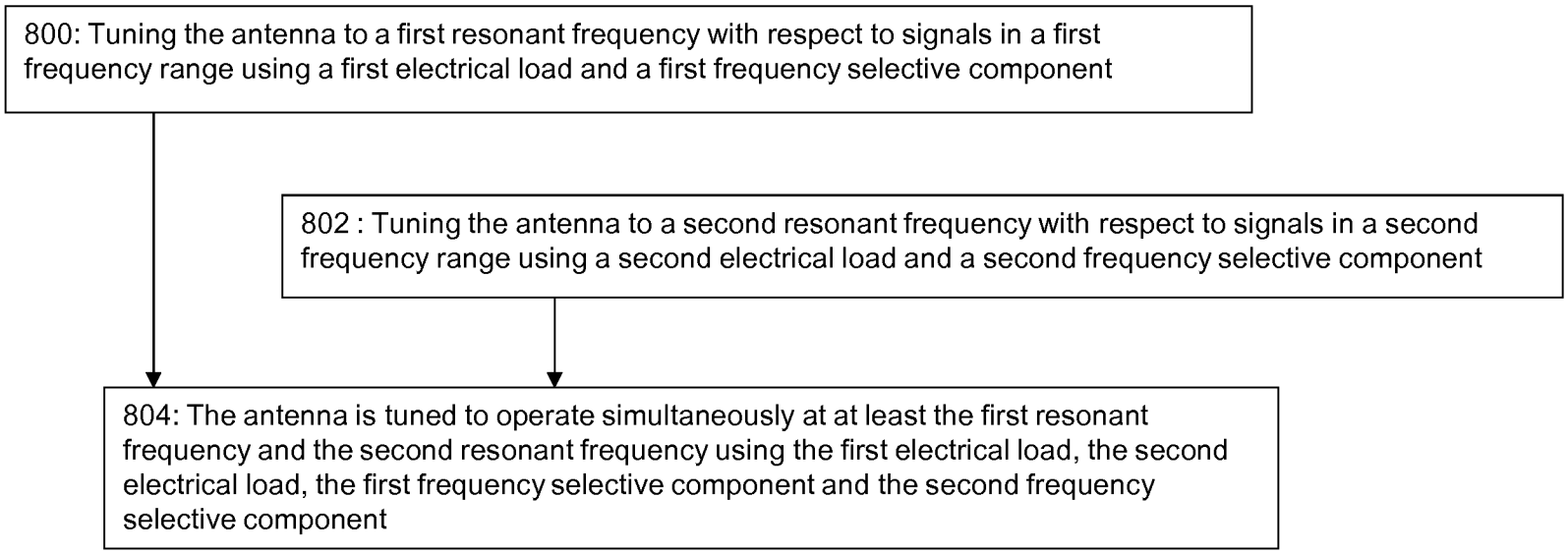
FIG. 8 is a logic flow diagram that illustrates the steps involved in tuning a user equipment antenna according to embodiments.

FIG. 8 is a flow diagram that describes embodiments from the perspective of the UP 700, and in this regard, FIG. 8 represents steps performed by one or a combination of the aforementioned control circuitry, digital signal processor, processing system or processors, baseband circuitry and radio frequency circuitry.

At step 800, the antenna is tuned to a first resonant frequency with respect to signals in a first frequency range using a first electrical load and a first filter. At step 802 the antenna is tuned to a second resonant frequency with respect to signals in a second frequency range using a second electrical load and a second filter. The result of these steps is to tune the antenna to operate simultaneously at at least the first resonant frequency and the second resonant frequency using the first electrical load, the second electrical load, the first frequency selective component and the second frequency selective component, as shown by 804. Whilst step 800 is depicted before step 802, it should be understood that these steps occur contemporaneously to allow simultaneous tuning of the antenna to both the first and second resonant frequencies.

A user equipment includes any device capable of conducting wireless communications, and includes in particular mobile devices such as mobile or cell phones, personal digital assistants, pagers, tablet and laptop computers, content-consumption or generation devices (for music and/or video data for example), as well as fixed or relatively static devices, such as personal computers, game consoles and other generally static entertainment devices. A user equipment may also include a separate module such as a data card, modem device, USB dongle, chip, chipset, system in package (SIP) etc. which can be attached to various devices, including consumer electronics, ears, measuring devices, sensors, public safety devices, security or supervision systems or other public authority electronics, billboards, positioning systems etc. to facilitate wireless communications.

In embodiments, a user equipment antenna apparatus is provided, comprising:

a first electrical load;

a second electrical load;

a first frequency selective component; and a second frequency selective component, wherein the first electrical load and the first frequency selective component are adapted to tune the antenna to a first resonant frequency with respect to signals in a first frequency range, wherein the second electrical load and the second frequency selective component are adapted to tune the antenna to a second resonant frequency with respect to signals in a second frequency range, and wherein the first electrical load, the second electrical load, the first frequency selective component and the second frequency selective component are adapted to tune the antenna to operate simultaneously at at least the first resonant frequency and the second resonant frequency.

In embodiments, the apparatus comprises a control module, wherein the control module is comprised in one or more of:

the user equipment;

an application processor;

a modem, and a radio frequency integrated circuit.

In embodiments, the apparatus is adapted to receive a control signal from a network, the control signal being operable to perform one or more of:

alter the range of frequencies passed by at least one of the first frequency selective component and the second frequency selective component; and alter the impedance of at least one of the first electrical load and the second electrical load.

In embodiments, the apparatus comprises:

a first electrical interface;

a second electrical interface;

a third frequency selective component adapted to selectively pass signals in the first frequency range between the antenna and the first electrical interface; and a fourth frequency selective component adapted to selectively pass signals in the second frequency range between the antenna and the second electrical interface.

In embodiments, the range of frequencies passed by at least one of the third frequency selective component and the fourth frequency selective component is controllable, whereby to alter the range of frequencies comprised by at least one of the first frequency range and the second frequency range.

In embodiments, the control module is adapted to alter the range of frequencies passed by at least one of the third frequency selective component and the fourth frequency selective component.

In embodiments, the control signal is operable to alter the range of frequencies passed by at least one of the third frequency selective component and the fourth frequency selective component.

In embodiments, the apparatus comprises a first signal processing component electrically connected to the antenna via the first electrical interface and a second signal processing component electrically connected to the antenna via the second electrical interface.

In embodiments, each the signal processing component comprises one or more of:

a switch, a power amplifier, a filter bank, and an antenna tuner.

In embodiments, the apparatus comprises a third electrical interface and a yet further frequency selective component, wherein the yet further frequency selective component is adapted to selectively pass signals in the third frequency range between the antenna and the third electrical interface.

In embodiments, the apparatus is adapted to alter at least one of the second resonant frequency and the range of frequencies comprised by the second frequency range whilst the user equipment conducts communications in the first frequency range via the antenna.

In embodiments, the altered second resonant frequency and/or the altered range of frequencies comprised by the second frequency range comprise an alternative operational frequency for the communications conducted in the first frequency range.

In embodiments the altered second resonant frequency and/or the altered range of frequencies comprised by the second frequency range comprise an operational frequency for communications other than those conducted in the first frequency range.

In embodiments at least one of the first frequency range and the second frequency range correspond to a carrier in a carrier aggregation scheme.

In embodiments the first frequency range and the second frequency range correspond to different frequency bands in a radio communication standard.

In embodiments the first frequency range and the second frequency range are associated with different radio access technologies.

In embodiments, at least one of the first frequency range and the second frequency range are associated with one or more satellite positioning receivers.

In embodiments, at least one of the first frequency range and the second frequency range are associated with a short range communication system.

The above embodiments are to be understood as illustrative. Further embodiments are envisaged. For example, each filter block may include filters that connect the antenna to any combination of electrical interfaces and/or electrical loads. In such configurations, the other filter block connects the antenna to each corresponding electrical interface and/or electrical load. Additionally, where the controllable components in the tuning apparatus have been described as being electrically controlled, according to some embodiments, the controllable components may be manually controlled, for example via a user input. It is to be understood that any feature described in relation to any one embodiment may be used alone, or in combination with other features described, and may also be used in combination with one or more features of any other off the embodiments, or any combination of any other of the embodiments. Furthermore, equivalents and modifications not described above may also be employed without departing from the scope of the invention, which is defined in the accompanying claims.

What is claimed is:

1. An electronic device comprising:

a first electrical load;

a second electrical load;

a first frequency selective component;

a second frequency selective component, wherein the first electrical load and the first frequency selective component are configured to tune an antenna to a first resonant frequency with respect to signals in a first frequency range, the second electrical load and the second frequency selective component are configured to tune the antenna to a second resonant frequency with respect to signals in a second frequency range, and the first electrical load, the second electrical load, the first frequency selective component and the second frequency selective component are configured to tune the antenna to operate simultaneously at at least the first resonant frequency and the second resonant frequency; and control circuitry configured to perform one or more of altering a characteristic of at least one of the first frequency selective component and the second frequency selective component to alter a range of frequencies passed by at least the at least one of the first frequency selective component and the second frequency selective component; or altering an impedance of at least one of the first electrical load and the second electrical load.

2. The electronic device according to claim 1, wherein the first frequency selective component is configured to selectively pass signals in the first frequency range between the antenna and the first electrical load, and the second frequency selective component is configured to selectively pass signals in the second frequency range between the antenna and the second electrical load.

3. The electronic device according to claim 1, wherein the first frequency selective component and the second frequency selective component each comprise a filter.

4. The electronic device according to claim 1, wherein the first electrical load and the second electrical load each comprise a reactive load.

5. The electronic device according to claim 1, wherein the first resonant frequency comprises a frequency within the first frequency range, and the second first resonant frequency comprises a frequency within the second frequency range.

6. The electronic device according to claim 1, wherein the electronic device comprises a chipset.

7. The electronic device according to claim 1, wherein the first frequency selective component is a filter, and the control circuitry is configured to alter a filter profile of the filter.

8. The electronic device according to claim 1, wherein the second frequency selective component is a filter, and the control circuitry is configured to alter a filter profile of the filter.

9. The electronic device according to claim 1, wherein the first frequency selective component is a reactive load, and the control circuitry is configured to alter an impedance of the reactive load.

10. The electronic device according to claim 1, wherein the second frequency selective component is a reactive load, and the control circuitry is configured to alter an impedance of the reactive load.

11. An electronic device comprising:

a first electrical interface;

a second electrical interface;

a first electrical load;

a second electrical load;

a first frequency selective component;

a second frequency selective component;

a third frequency selective component configured to selectively pass signals in a first frequency range between an antenna and the first electrical interface; and a fourth frequency selective component configured to selectively pass signals in a second frequency range between the antenna and the second electrical interface, wherein the first electrical load and the first frequency selective component are configured to tune the antenna to a first resonant frequency with respect to signals in the first frequency range, the second electrical load and the second frequency selective component are configured to tune the antenna to a second resonant frequency with respect to signals in the second frequency range, and the first electrical load, the second electrical load, the first frequency selective component and the second frequency selective component are configured to tune the antenna to operate simultaneously at at least the first resonant frequency and the second resonant frequency.

12. The electronic device according to claim 11, further comprising:

first signal processing circuitry electrically connected to the antenna via the first electrical interface; and second signal processing circuitry electrically connected to the antenna via the second electrical interface.

13. The electronic device according to claim 12, wherein the first and second signal processing circuitry each comprise one or more of:

a transmitter, a receiver, or a transceiver.

14. The electronic device according to claim 12, wherein the first signal processing circuitry is configured to transmit and/or receive first signals in the first frequency range via the antenna, and the second signal processing circuitry is configured to transmit and/or receive second signals in the second frequency range via the antenna.

15. The electronic device according to claim 12, wherein the first signal processing circuitry and the second signal processing circuit are configured to transmit and/or receive signals via the antenna simultaneously.

16. The electronic device according to claim 11, wherein the first frequency selective component and the fourth frequency selective component comprise a first duplex filter, and the second frequency selective component and the third frequency selective component comprise a second duplex filter.

17. The electronic device according to claim 11, wherein the first frequency selective component and the second frequency selective component comprise a first duplex filter, and the third frequency selective component and the fourth frequency selective component comprise a second duplex filter.

18. An electronic device comprising:

a first electrical load;

a second electrical load;

a third electrical load;

a first frequency selective component;

a second frequency selective component; and a third frequency selective component, wherein the first electrical load and the first frequency selective component are configured to tune an antenna to a first resonant frequency with respect to signals in a first frequency range, the second electrical load and the second frequency selective component are configured to tune the antenna to a second resonant frequency with respect to signals in a second frequency range, the third electrical load and the third frequency selective component are configured to tune the antenna to a third resonant frequency with respect to a third frequency range, and the first electrical load, the second electrical load, the third electrical load, the first frequency selective component, the second frequency selective component and the third frequency selective component are configured to tune the antenna to operate simultaneously at at least the first resonant frequency, the second resonant frequency and the third resonant frequency.

19. The electronic device according to claim 18, wherein the third frequency selective component is configured to selectively pass signals in the third frequency range between the antenna and the third electrical load.

* * * * *